US005585588A

United States Patent [19]

Tumura

[11] Patent Number: 5,585,588

[45] Date of Patent: Dec. 17, 1996

[54] ELECTRIC STRINGED INSTRUMENT HAVING A DEVICE FOR SUSTAINING THE VIBRATION OF A STRING AND AN ELECTROMAGNETIC DRIVER FOR THE DEVICE

[75] Inventor: Kenji Tumura, Osaka, Japan

[73] Assignee: Fernandes Co., Ltd., Japan

[21] Appl. No.: 434,266

[22] Filed: May 3, 1995

Related U.S. Application Data

[63] Continuation of Ser. No. 966,006, Oct. 23, 1992, abandoned.

[30] Foreign Application Priority Data

| | | | |
|---|---|---|---|
| Oct. 24, 1991 | [JP] | Japan | 3-277837 |
| Dec. 6, 1991 | [JP] | Japan | 3-323003 |
| Dec. 27, 1991 | [JP] | Japan | 3-346480 |

[51] Int. Cl.[6] ..... G10H 1/057; G10H 3/18

[52] U.S. Cl. ..... 84/726; 84/738; 84/DIG. 10

[58] Field of Search ..... 84/723–743, DIG. 10

[56] References Cited

U.S. PATENT DOCUMENTS

| | | | |
|---|---|---|---|
| 4,075,921 | 2/1978 | Heet | 84/738 |
| 4,143,575 | 3/1979 | Oliver . | |
| 4,181,058 | 1/1980 | Suenaga | 84/726 |
| 4,236,433 | 12/1980 | Holland . | |
| 4,245,540 | 1/1981 | Groupp | 84/726 |
| 4,269,103 | 5/1981 | Underwood . | |
| 4,524,667 | 6/1985 | Duncan . | |
| 4,809,578 | 3/1989 | Lace . | |
| 4,907,483 | 3/1990 | Rose et al. . | |
| 4,941,388 | 7/1990 | Hoover et al. . | |

FOREIGN PATENT DOCUMENTS

| | | |
|---|---|---|
| 9100689 U | 7/1991 | Germany . |
| WO89/11717 | 11/1989 | WIPO . |

*Primary Examiner*—Stanley J. Witkowski

*Attorney, Agent, or Firm*—Finnegan, Henderson, Farabow, Garrett & Dunner, L.L.P.

[57] ABSTRACT

A stringed instrument having a device for sustaining the vibration of a string; the stringed instrument being a musical instrument having plural strings with the mass and tension of each string being different, which has a pickup unit for detecting the vibration of a string, an amplifying unit for amplifying an electric signal detected by the pickup unit, an electromagnetic driver for emitting magnetic energy to drive a string by a driving signal output from the amplifying unit, and an excitation balance matching unit for providing well-balanced excitation to each of the plural strings and/or a magnetic flux emission controlling unit for increasing the quantity of magnetic flux emission in the direction of a string.

49 Claims, 13 Drawing Sheets

ELECTRIC STRINGED INSTRUMENT HAVING A DEVICE FOR SUSTAINING THE VIBRATION OF A STRING AND AN ELECTROMAGNETIC DRIVER FOR THE DEVICE

This application is a continuation, of application Ser. No. 07/966,006 filed Oct. 23, 1992, now abandoned.

BACKGROUND OF THE INVENTION

1. Field of the Invention

The present invention relates to a stringed instrument, e.g., a guitar or a piano, and more particularly to a stringed instrument having a device that drives the strings thereof to sustain the vibration of the string and an electromagnetic driver for the device.

A guitar or a piano differs from a violin in that after the string of a guitar or a piano is excited, the magnitude of the vibration of the string will become half within about a half second and die within about 7 seconds. Particularly, for example, in the case of an electric guitar, it seems that the attenuation speed of the vibration of the string is shorter than that of an acoustic guitar because of the electric characteristics of an amplifier. Thus, an effector, which is a device for adding several sound effects, e.g., Delay, Reverb, Compressor, Overdrive, etc., to the sound of the guitar is often used to enable more sustained sound to be heard acoustically.

An effector using Delay or Reverb adds reverberations to a musical sound, and the sound is produced by recording and playing back the sound on a magnetic tape or by delaying the tone by a spring arrangement. Recently, simple electronic devices using BBD (Bucket Brigade Device) have been utilized for the Delay or the Reverb. An effector using a Compressor increases the amplitude of a music signal sent to by an amplifier in reverse proportion to attenuation characteristics of the vibration of the strings, and an Overdrive amplifies the signal beyond a generally permissible level so as to obtain a long tone. A longer tone can be achieved by using these effectors, although the effectors cannot maintain the tone after the vibration of the string has stopped.

Currently, musicians investigate various sounds and develop the art of musical performance in order to play said various sounds in response to their individual performance. For example, a style using a loudspeaker feedback is one that produces the sound of a guitar at high volume so as to sustain the vibration of the string on the guitar for a long time without attenuation by way of sympathetic vibration in cooperation with air vibration emitted from the loudspeaker. As described above, the feedback can maintain the vibration of the string for a long time, but in order to sustain the sound, the player must utilize a skilled and high-grade technique to overcome several limitations, i.e., sound volume, location of the amplifier, length of the strings and musical interval, etc. Further, there is a weak point in that the tone of the first string on the treble side, which is the most significant for musical expression, cannot be easily sustained. Therefore, a device that easily sustains the vibration of the string for an extended period has been in demand for a long time.

2. Description of the Prior Art

Several devices for sustaining the vibration of strings are disclosed in relation to an electric guitar. For example, U. S. Pat. No. 4,941,388 (Hoover, et al.) and U. S. Pat. No. 4,907,483 (Rose, et al.) disclose an arrangement of an electric guitar having such a device, the former is referred to by the trade name of "Sustaniac" and the latter by the trade name of "Kramer-Floyd Rose Sustainer" and both has been put into practical use and are available on the market.

Although an electric guitar having the device that is put into practical use as described above can excite and sustain the vibration of the strings quite adequately, there are some problems from the point of view of a musical instrument.

The first problem is that a stringed instrument, e.g., a guitar and a piano, has plural strings and the thickness and tension of every string is different, and so the driving force applied to each of them is also different. Namely, in a conventional case an electromagnetic driver of a stringed instrument having a device for sustaining the vibration of the string, for example an electric guitar, emits a constant driving magnetic energy against every string uniformly so that the first string that has the smallest mass and thickness and relatively large tension cannot be excited, oppositely, the fifth string and the sixth string can be excited easily because of the large mass and thickness and relatively low tension of the string.

Therefore, in such a self excitation system there are several defects in that a player cannot participate in the operation of volume control between the strings overall and various tones produced by large and small vibrations of each string give the player an unpleasant feeling occasionally, and although the first string is the most important for musical expression, the first string cannot be excited easily in comparison with the other strings since the first string is the finest out of the strings and its mass is the lightest.

Furthermore, there is another problem that a string other than the first string, e.g., the fifth string or the sixth string, experiences sudden self-excitation when providing the first string with increased driving force in order to solve the problem as described above.

It is difficult to maintain a balance between the vibration of each string as described above, and if an optimum magnetic energy output for driving a string is adjusted to the least excitable string, e.g., a first string, the optimum magnetic energy output for driving the first string provides a relatively excitable string, e.g., a fifth string or a sixth string, with excessive driving energy, and thereby, there is a problem in that a fifth string or a sixth string experiences sudden self-excitation by the excessive driving energy described above although the fifth or sixth string is not used for playing music. To prevent said problem, a musician must always mute the fifth and sixth string while playing the guitar and that is a serious problem for the musician.

Also, a method of playing a chord that simultaneously plays plural strings in such a stringed instrument is very important for musical performance, however, there is a defect in that only a particular string is excited by an excitation imbalance between the strings as described above and so it is impossible to play a chord in the prior art.

Next, the second problem is the emission efficiency of driving magnetic energy. Namely, for example in the case of an electric guitar, it is most preferable to mount a device for sustaining the vibration of a string on a guitar body as a package, and it is clear that an external effector type guitar is substantially inferior to an internal effector type guitar. Also in the internal effector type guitar, a power supply unit for a device for sustaining the vibration of a string must be essentially small, e.g., a small dry cell battery, to be mounted inside a guitar body. A driving current used to excite a string in such an excitation system is usually about 50 mA, and so the emission efficiency of driving magnetic energy is very important so as to prevent the necessity of frequently changing the dry cell battery.

As for an electromagnetic driver of a device for sustaining the vibration of a string mounted on an electric guitar, a bar type pole piece is generally used to enable the guitar to be played using a method for changing pitch, e.g., bending, in which a string is drawn on a fret parallel with the fret by the finger, and thereby, tension of the string and pitch vary. Conversely, a single type pole piece is scarcely used, because magnetic energy emitted from each pole piece corresponding to each string lies in the neighborhood of just above each pole piece so that a cut tone is generated if a string is out of the magnetic energy area while playing using the Bending method.

A bar type pole piece has a flat magnetic flux emitting characteristic and a magnetic field is formed in the up and down direction uniformly. However, circular magnetic fields are formed in the neighborhood of both side ends of a bar type pole piece. Therefore, a magnetic field provided to the strings from a second string to a fifth string is relatively stable and uniform, but a magnetic field provided to a first string and a sixth string is curved as described above so that magnetic field density falls and the driving force for driving a first string and a second string is smaller rather than that for other strings, and excitation balance between strings is lost thereby.

Further, magnetic flux emitted from a bar type pole piece in the reverse direction of the strings is not used to drive a string and so energy is wasted.

SUMMARY OF THE INVENTION

The purpose of the present invention is to solve the problems described above. To solve the first problem related to an excitation imbalance between strings, an excitation balance matching means is provided.

Briefly, the excitation balance matching means is a phase control circuit provided in an amplifier and/or means for properly setting up magnetic flux emitted from an electromagnetic driver corresponding to each string.

Also, to solve the second problem related to an emission efficiency of driving magnetic energy, a magnetic flux emission controlling means for controlling the relative quantity of magnetic flux emission corresponding to each string is provided.

Further, the purpose of the present invention is to develop consumption efficiency by providing a driving proper and sufficient magnetic energy to each string, using the excitation balance matching means. Furthermore, the purpose of the present invention is to provide a new designed electromagnetic driver that significantly develops the magnetic energy emitting characteristics.

According to the present invention a stringed instrument having a device for sustaining the vibration of a string; said stringed instrument being a musical instrument having plural strings with the mass and tension of each string being different, comprises pickup means for detecting the vibration of a string, amplifying means for amplifying an electric signal detected by said pickup means, an electromagnetic driver for emitting magnetic energy to drive a string by a driving signal output from said amplifying means, and excitation balance matching means for providing well-balanced excitation to each of the plural strings and/or magnetic flux emission controlling means for increasing the quantity of magnetic flux emission in the direction of a string.

The excitation balance matching means is a phase control circuit provided in said amplifying means and the phase control circuit has a fixed phase characteristic and causes each string to be excited by a substantially uniform and well-balanced driving force such that the least excitable string is provided with an optimum condition of the phase characteristic so as to sustain the vibration of the string, and other strings are provided with a progressively mismatched condition so as to suitably weaken the vibration of the strings.

Further, according to the present invention, an electromagnetic driver of a device for sustaining the vibration of a string that is used in a musical instrument having plural strings, the mass and tension of each string being different, comprises pickup means for detecting the vibration of a string, amplifying means for amplifying an electric signal detected by said pickup means, an electromagnetic driver for emitting magnetic energy so as to drive a string by an output signal from said amplifying means, and excitation balance matching means for providing well-balanced excitation to each of the plural strings and/or magnetic flux emission controlling means for increasing the quantity of magnetic flux emission in the direction of a string.

The electromagnetic driver has the arrangement of a coil and plural pole pieces corresponding to plural strings and said excitation balance matching means has a constitution for setting up a magnetic flux emitted from each pole piece properly so as to emit well-suited magnetic flux corresponding to each string respectively, and the electromagnetic driver has an arrangement of a permanent magnet, a coil and a bar type pole piece combined with the permanent magnet magnetically, and the excitation balance matching means and/or the magnetic flux emission controlling means are magnetic flux emission deflecting means formed in the bar type pole piece for deflecting emitted magnetic flux.

Furthermore, according to the present invention a stringed instrument having a device for sustaining the vibration of a string; the stringed instrument being a musical instrument having plural strings, the mass and tension of each string being different, comprises pickup means for detecting the vibration of a string, amplifying means for amplifying an electric signal detected by the pickup means, and an electromagnetic driver for emitting magnetic energy to drive a string by a driving signal output from the amplifying means, characterized in that the device for sustaining the vibration of a string sustains the vibration of plural strings simultaneously thereby enabling the playing of a chord.

BRIEF DESCRIPTION OF THE DRAWINGS

The present invention will be more clearly understood from the description as set forth below with reference to the accompanying drawings.

DESCRIPTION OF THE PREFERRED EMBODIMENTS

Figure 1:
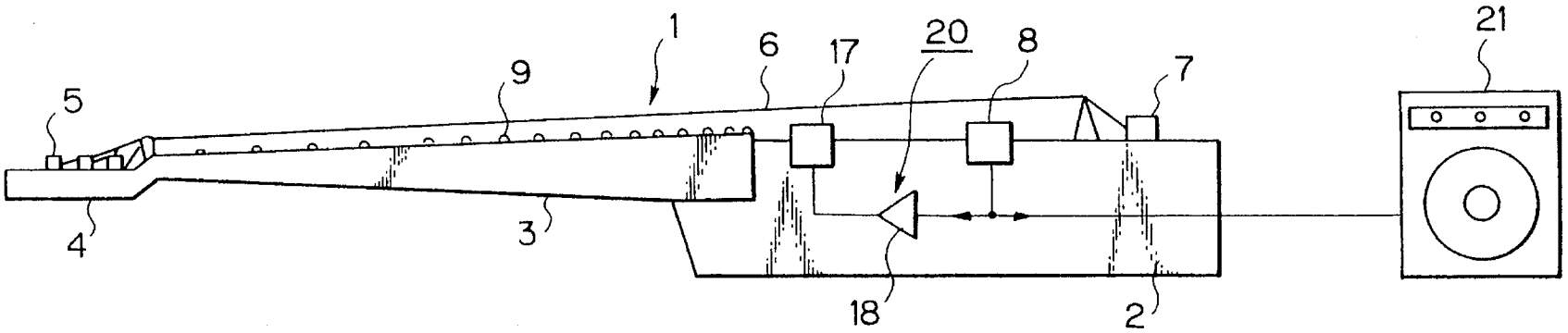
FIG. 1 is a general schematic arrangement of an electric guitar having a device for sustaining the vibration of strings.
Figure 2:
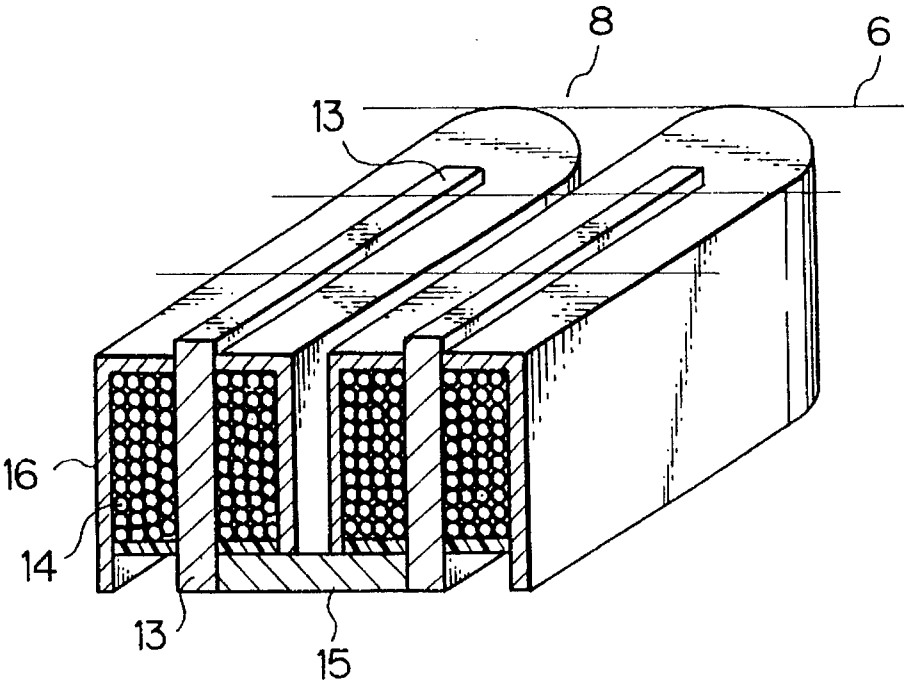
FIG. 2(*a*) and FIG. 2(*b*) are cross sectioned views of two types of electromagnetic pickups; one is a so-called single coil type pickup in FIG. 2(*a*) and the other is a so-called double coil type pickup in FIG. 2(*b*).
Figure 2:
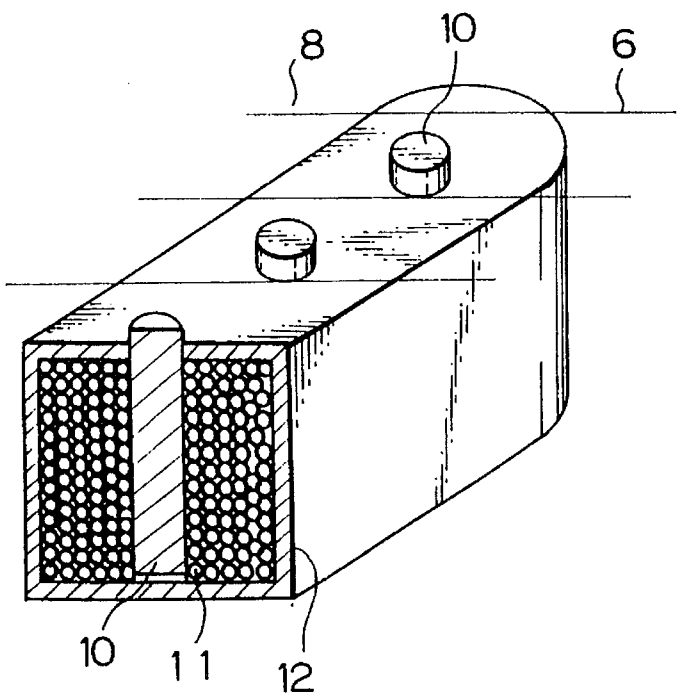
Figure 3:
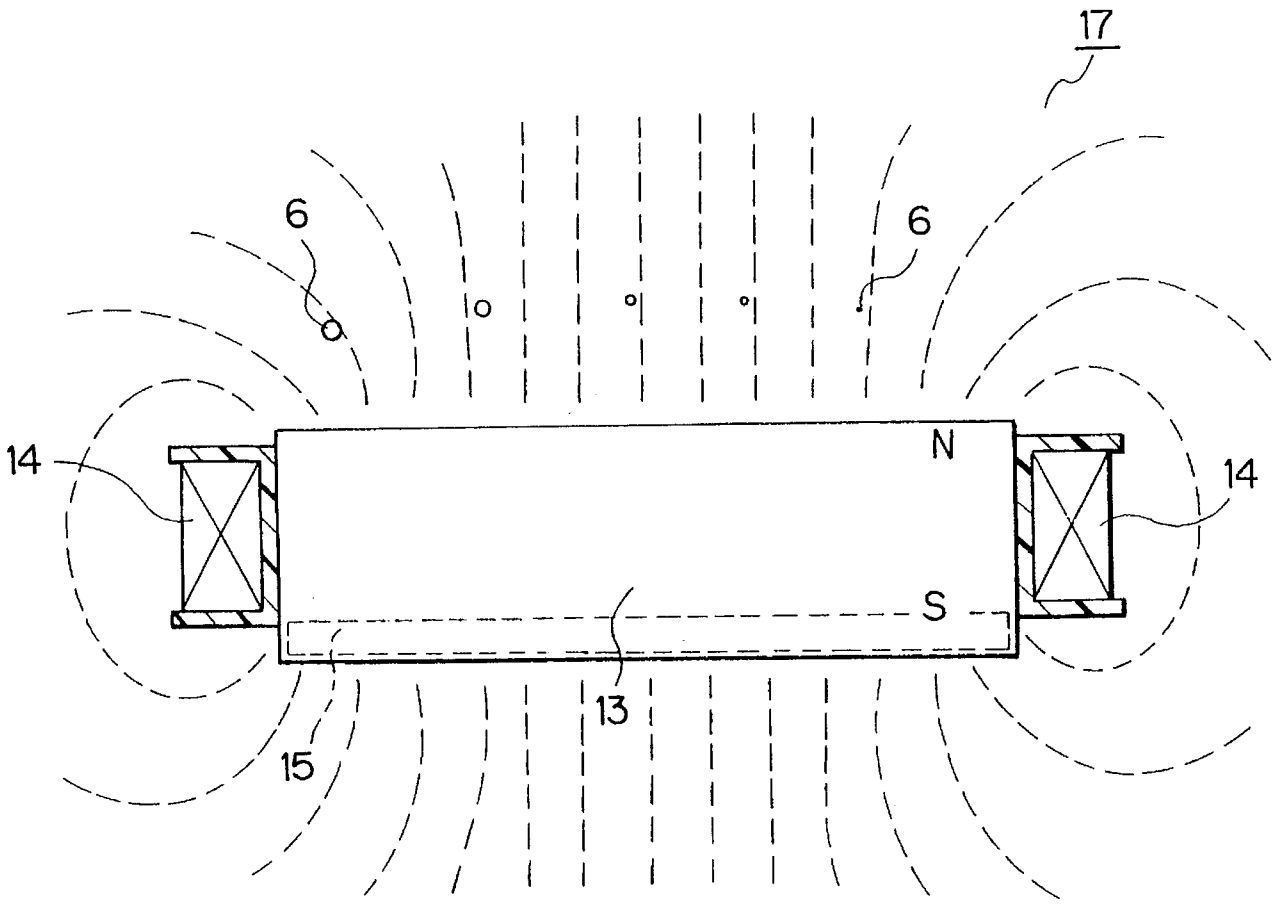
FIG. 3 is a schematic view of a magnetic field emitted from a electromagnetic pickup.

Before describing the preferred embodiments according to the present invention, examples of the related art are provided with reference to accompanying drawings (FIG. 1, FIG. 2(*a*), (*b*) and FIG. 3).

FIG. 1 shows an electric guitar that has a so-called "sustainer" 20 for sustaining the vibration of a string 6. In FIG. 1, an electric guitar 1 has a body 2 and a neck 3 combined with the body 2. Frets 9 are placed side by side on the surface of the neck 3 and a head 4 is shaped at an elongated end portion of the neck 3. A plurality of pegs 5 (string winders) are attached to the head 4 and each peg 5 has a structure for winding up one end of the string 6 made of a metal conductive wire. The other end of the string 6 is fixed at a tailpiece attached to the surface of the body 2 or a Tremolo device 7 for producing a Tremolo effect characteristic of an electric guitar by a bar that provides pitch change capability by varying string tension. 8 is an electromagnetic pickup. There are typically two types of pickups 8 as shown in FIG. 2(*a*) and FIG. 2(*b*).

FIG. 2(*a*) is a so-called single coil type pickup that comprises pole pieces 10 made of a magnetic substance, i.e., a permanent magnet, a coil 11 wound around the pole pieces 10 and a cover 12. FIG. 2(*b*) is a so-called double coil type pickup or a hum-bucking pickup that comprises two pole pieces 13 facing each other and made of magnetic substances, i.e., a ferromagnetic material (FIG. 2(*b*) shows an example of a so-called bar type pole-piece.), coils 14 wound up around each pole piece 13 and a permanent magnet 15 combined magnetically with each pole piece 13. An induced electromotive force generated at both ends of the coil 11, 14 of the electromagnetic pickup 8 is produced by a variation of magnetic flux penetrating through the inside of the circumference of the coil 11, 14. The vibration of the conductive metal string 6 in the magnetic field causes a change in magnetic reluctance in the neighborhood of the electromagnetic pickup 8 and thereby the magnetic flux density inside of the circumference of the coil 11, 14 varies in response to the vibration and an electric signal is produced by the induced electromotive force.

In such a case of an electric guitar, the sustainer 20 consists fundamentally of the following elements. There are three elements, those are, an electromagnetic pickup 8 for detecting the vibration of the string 6, an amplifier 18 for amplifying an electric signal detected by the electromagnetic pickup 8, and an electromagnetic driver 17 for emitting a driving magnetic energy converted from the electric signal. The sustainer 20 as described above operates in the following manner.

A signal detected at the electromagnetic pickup 8 is applied to an external guitar amplifier 21 and the guitar amplifier 21 outputs a loud sound. The signal of the vibration of the string 6 detected at the electromagnetic pickup 8 is also applied to the amplifier 18 within the guitar body 2 and the amplified signal is applied to the electromagnetic driver 17. The electromagnetic driver 17 basically uses the inverse of the principle of the electromagnetic pickup 8. The electric signal detected at the electromagnetic pickup 8 is amplified by the amplifier 18 and provided to an electromagnetic transducer, i.e., the electromagnetic drive 17. The electromagnetic driver 17 has the same structure as the electromagnetic pickup 8 shown in FIG. 2(*a*) or FIG. 2(*b*) and causes the string 6 to be excited by the emitted magnetic flux. However, the coil portion of the electromagnetic driver 17 is not the same as the electromagnetic pickup 8 because the electromagnetic driver 17 needs a lot of power to obtain significant flux and thereby to drive the string 6. Accordingly the coil of the electromagnetic driver 17 uses a copper wire with a diameter of 0.3 mm larger than that of the electromagnetic pickup 8 and about 200 turns of the wire is wound, therefore the electromagnetic driver 17 has small electric resistance about 7 ohm and low power-loss characteristics.

As for an electromagnetic driver of a device for sustaining the vibration of a string mounted on an electric guitar, a bar type pole piece is generally used to enable the guitar to be played using a method for changing pitch, e.g., bending, in which a string is drawn on a fret parallel with the fret by the finger, and thereby, tension of the string and pitch vary. Conversely, a single type pole piece is scarcely used, because magnetic energy emitted from each pole piece corresponding to each string lies in the neighborhood of just above each pole piece so that a cut tone is generated if a string is out of the magnetic energy area while playing using the Bending method.

As shown in FIG. 3, a bar type pole piece 13 has a flat magnetic flux emitting characteristic and a magnetic field is formed in the up and down direction uniformly. However, a circular magnetic fields is formed in the neighborhood of both side ends of a bar type pole piece 13. Therefore, a magnetic field provided to strings 6 from a second string to a fifth string is relatively stable and uniform, but a magnetic field provided to a first string and a sixth string is curved as described above so that a magnetic field density falls and so driving force for driving a first string and a second string is smaller rather than that for other strings, and an excitation balance between strings is lost thereby.

Further, magnetic flux emitted from a bar type pole piece 13 in the reverse direction of strings 6 is not used to drive a string 6 and so it was wasted as useless energy.

In the following, the preferred embodiments corresponding to respective means described above according to the present invention are described briefly with reference to accompanying drawings.

Figure 4:
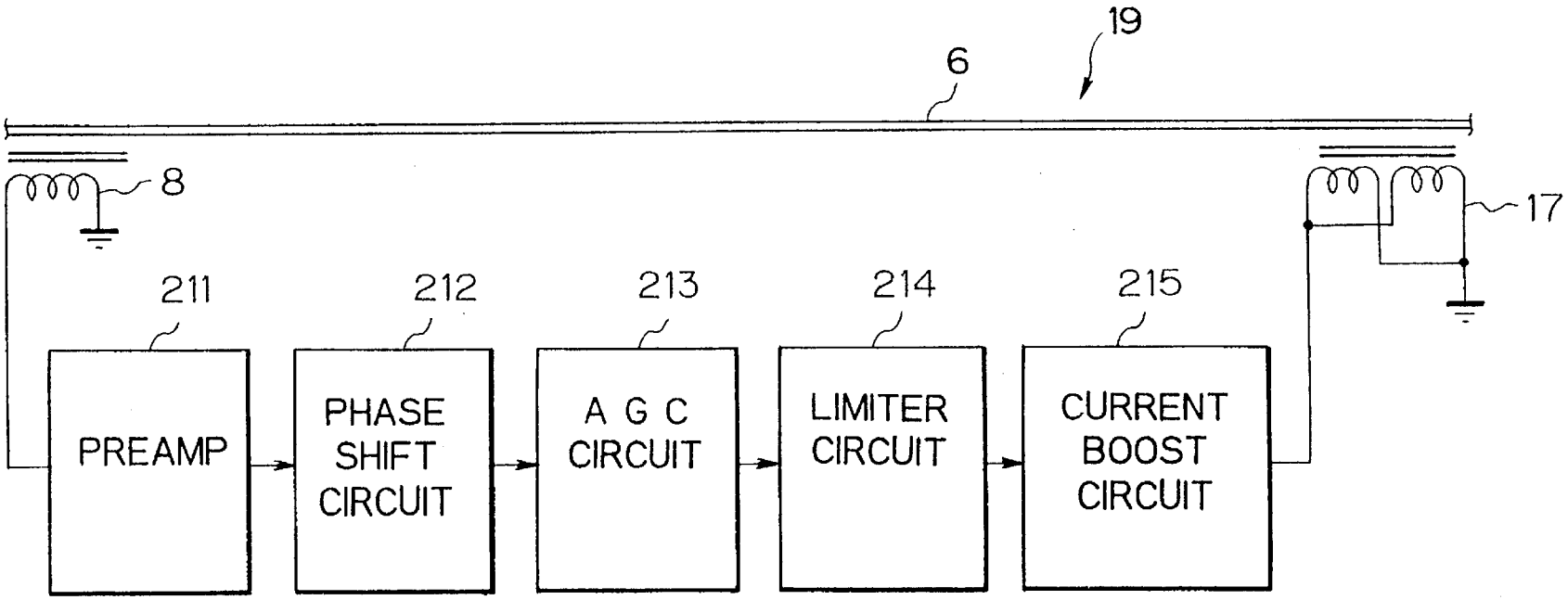
FIG. 4 is an example of block diagrams of a device for sustaining the vibration of a string.
Figure 5:
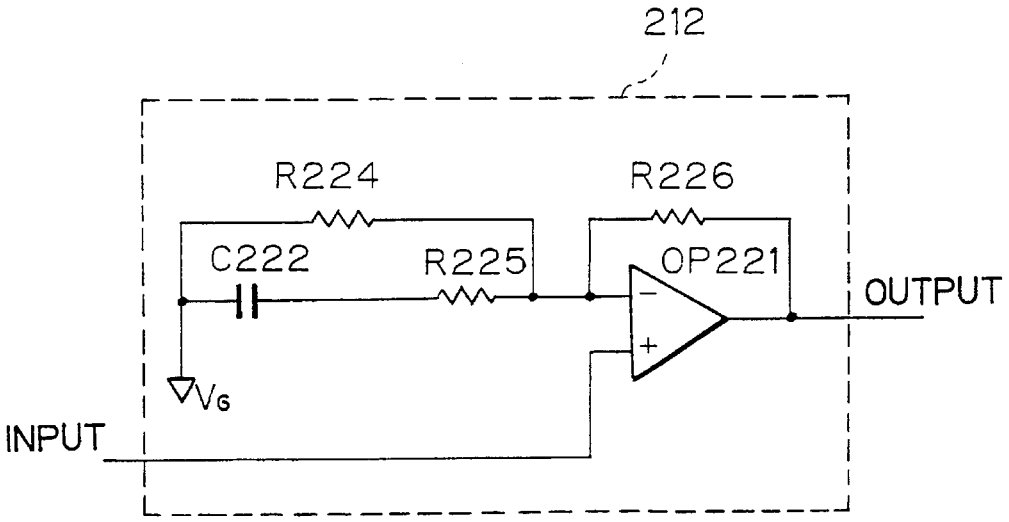
FIG. 5 is an example of a phase shift circuit.
Figure 6:
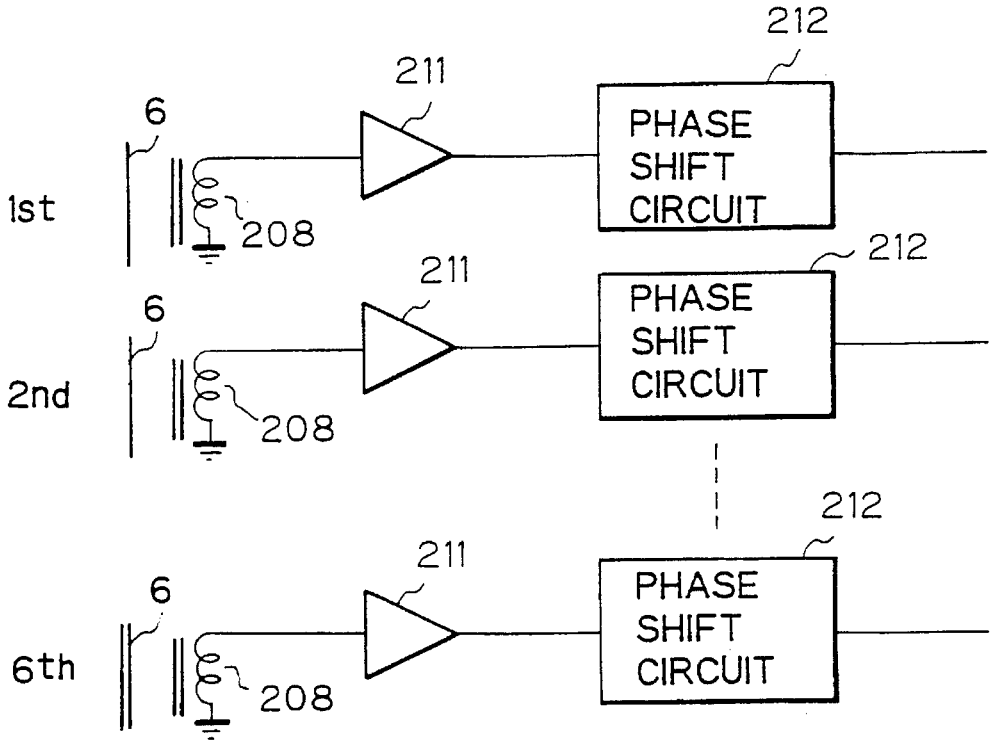
FIG. 6 is a schematic view of an example of a device for sustaining the vibration of a string in which plural phase shift circuits are used corresponding to each string.

First, an embodiment of means for matching a balance of excitation of plural strings at an optimum phase, mass and tension of each of which is different, is explained briefly with reference to FIG. 4–6. The means has a constitution that suitable adjusting an output phase of magnetic energy to cause the least excitable string, for example a first string, to be driven efficiently and shifts the output phase of magnetic energy intentionally in relation to a fifth string that can be easily excited, and thereby, matches the excitation balance of the plural strings overall.

FIG. 4 is a block diagram of an embodiment of a device for sustaining the vibration of strings according to the present invention. These circuit elements are mounted on a circuit board located inside a guitar body, except for a string 6, an electromagnetic pickup 8 and an electromagnetic driver 17. In FIG. 4, preamp 211 is a preamplifier for amplifying a micro-vibrational signal of the string 6 detected by the electromagnetic pickup 8, and an output of the preamp 211 is applied to a phase shift circuit 212 at a subsequent stage. The phase shift circuit 212 is a phase lead circuit that decreases in quantity of phase shift in proportion to an increase of a frequency of the input signal and has an amplitude characteristic which smoothly damps low frequency signals. The phase shift circuit 212 compensates for a phase lag between the electromagnetic pickup 8 and the electromagnetic driver 17, and thereby realizes a predetermined phase shift between the vibration of the string 6 and a driving force for the string 6, and also an effect of sustaining the vibration of the string 6, while maintaining a balance between the vibration of each string by damping low frequency signals and thereby reducing a so-called magnetic feedback to a low frequency string 6, e.g., a fifth string. The output of the phase shift circuit 212 is applied to an automatic gain control (AGC) circuit 213.

The AGC circuit 213 keeps the output signal level constant and provides the signal to a subsequent stage. The AGC circuit 213 solves the problem that the vibration of the string would be stopped if a quantity of the feed back for sustaining the vibration of the string were too small, and conversely that the vibration of the string would be self-excited if the quantity of the feed back were too large. The output of the AGC circuit 213 is applied to a limiter circuit 214.

The limiter circuit 214 prevents an over range input signal such as an impulse noise from a front stage and also incorporates the function of waveform shaping by limiting a leading edge and/or trailing edge of an input waveform, and thereby prevents an unusual feedback from being induced instantaneously.

A current boost circuit 215 amplifies a signal from the limiter circuit 214 and provides the amplified signal as a driving current to an electromagnetic driver 17. The electromagnetic driver 17 produces a magnetic field to excite the string 6 by the driving current.

FIG. 5 shows an example of the phase shift circuit 212 as described above. In FIG. 5, an input terminal has applied there to an output signal from the preamp 211 and an output signal from the phase shift circuit 212 is applied to the AGC circuit 213 at a subsequent stage. The circuit in FIG. 5 has a high-pass characteristic with a transfer function of $|T|=1+R226/R224$ at an angular frequency $\omega=0$ and $|T|=1+R226(R224+R225)/(R224\times225$ at $\omega=\infty$, and a phase lead characteristic that reduces a phase shift in inverse proportion to a signal frequency.

According to the present invention, the phase lead characteristic is matched to an optimum phase point for the maximum excitation of a first string that is the highest frequency string and the least excitable string because of its small mass and thickness, and for the other strings, particularly a fifth and a sixth string which are low frequency strings that can be excited more easily than the first string, it is shifted from the optimum phase point for their excitation. Consequentially, a total excitation balance between the strings from a first string to a sixth string is realized.

FIG. 6 shows a schematic view of a preferred embodiment of the present invention in which the phase shift circuits 212 are provided for every string from a first string to a sixth string, and considering the total excitation balance as described above, the quantity of phase shift of each phase shift circuit 212 is determined correctly in order to provide each string 6 with uniform and well-balanced excitation.

As described above, according to the present invention it is possible to drive plural strings to sustain the vibration of the strings simultaneously and uniformly, and thereby enable the playing of a chord although it was difficult to play a chord using a device for sustaining the vibration of the strings in the prior art.

Figure 7:
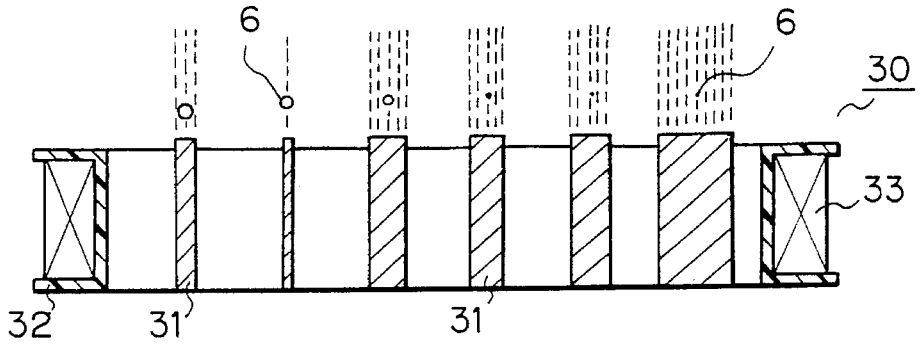
FIG. 7 is a schematic view of the first embodiment of the electromagnetic driver according to the present invention.

Next, a first embodiment of an electromagnetic driver having an excitation balance matching means that provides well-balanced magnetic energy to each of a plural of its strings, mass and tension of which being different each other, is explained briefly with reference to FIG. 7.

In FIG. 7, an electromagnetic driver 30 has cylindrical pole pieces 31 formed of a permanent magnet and corresponding to each string 6. A coil 33 is wound around a bobbin 32. The shapes of the permanent magnets forming the pole pieces 31 are different from each other to emit the optimum magnetic energy corresponding to each string 6, that is, a pole piece having large diameter is used to emit a large driving magnetic energy to a first string that has small mass and large tension and a pole piece having a small diameter is used to emit a small driving magnetic energy to a fifth string that has relatively large mass and small tension.

Next, embodiments, from the second embodiment to the fifth embodiment, of an electromagnetic driver having an excitation balance matching means and/or a magnetic flux emission controlling means are explained briefly with reference to FIGS. 8–11. The excitation balance matching means causes plural strings to be provided with well-balanced excitation and the magnetic flux emission controlling means controls relative emitting quantities of magnetic energy provided to each string.

According to these embodiments, the bar type pole piece as described above used in the electromagnetic driver is provided with a magnetic flux emission deflecting means so as to control relative emitting quantities of magnetic energy and/or a balance of magnetic flux emission corresponding to each string.

The magnetic flux emission deflecting means deflects useless magnetic flux that is not emitted in the direction of the string and thereby increases quantities of magnetic flux emitted in the direction of the string, and/or operates as a balancer that distributes the quantities of magnetic flux emitted to each string properly.

Figure 8:
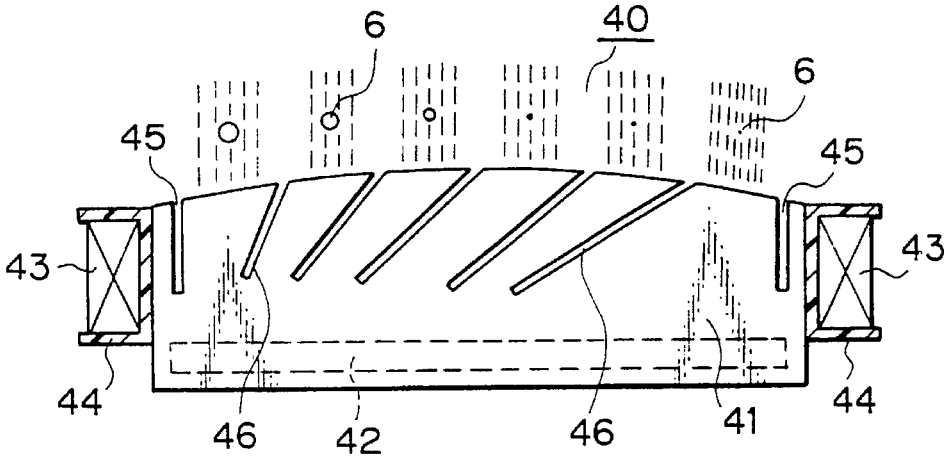
FIG. 8 is a schematic view of the second embodiment of the electromagnetic driver according to the present invention.

The second embodiment of an electromagnetic driver having the magnetic flux emission deflecting means described above is explained briefly with reference to FIG. 8 in the following. In FIG. 8, an electromagnetic driver 40 of this embodiment has a constitution of a double coil type pickup using a bar type pole piece as shown basically in FIG. 2(*b*). Namely, a bar type pole piece 41 is formed of a ferromagnetic material and is magnetically combined with a magnet 42 at the lower portion of the bar type pole piece 41. A coil 43 is wound around the bar type pole piece 41. Reference numeral 44 is a bobbin and 6 is strings. The bar type pole piece 41 has magnetic flux increasing slits 45 which function as a magnetic flux emission deflecting means and which are formed as magnetic air-gaps, at both sides of the bar type pole piece 41. The magnetic flux increasing slits 45 efficiently provide a quantity of magnetic flux to the strings 6 by deflecting magnetic flux in the neighborhood of both side ends of the strings 6, e.g., a first string and a sixth string, which has small flux density because of the magnetic flux curving in the normal direction of the flanks of the bar type pole piece 41. Also, the bar type pole piece 41 has emission balance control slits 46 in addition to the magnetic flux increasing slits 45. The emission balance control slits 46 efficiently provide a quantity of magnetic flux emitted from the magnet 42 to the strings 6 so as to cause each string 6 to vibrate uniformly by using the magnetic air-gaps. In this embodiment, in order to emit concentrated magnetic flux to a first string that is the least excitable string because it has the least thickness (the smallest mass) and relative large tension, the emission balance control slits 46 are formed in the bar type pole piece 41 such that the lower area between magnetic air-gaps corresponding to the first string is larger than the upper area between the magnetic air-gaps.

Next, the operation of the embodiment described above is explained. Magnetic flux from the magnet 42 is emitted to the strings 6 through the bar type pole piece 41, and the magnetic flux increasing slits 45 operates as a magnetic reluctance formed by the magnetic air-gap. The magnetic flux increasing slits 45 limit the magnetic flux emitted in the right and left direction in FIG. 8, and cause the deflected and concentrated magnetic flux to be emitted in the direction of the strings 6 as shown by a dotted line in FIG. 8, and thereby, increase a relative quantity of the magnetic flux emission in the direction of the strings 6. Also, the emission balance control slits 46 can control the emission balance of magnetic flux corresponding to an output or driving force of any string 6, e.g., a first string 6 in this embodiment, by concentrating the magnetic flux from the magnet 42 through the emission balance control slits 46.

Figure 9:
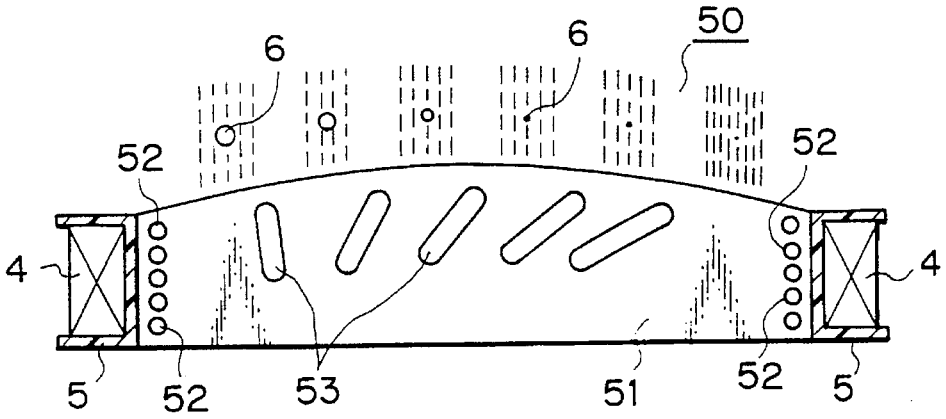
FIG. 9 is a schematic view of the third embodiment of the electromagnetic driver according to the present invention.

Next, the third embodiment of an electromagnetic driver having the magnetic flux emission deflecting means described above is explained briefly with reference to FIG. 9. In FIG. 9, the same portions as in the first embodiment have the same numerals as the first embodiment and the description in relation to those portions is omitted.

An electromagnetic driver 50 of this embodiment has the constitution of a single coil type pickup made of a magnet that basically forms a bar type pole piece itself. Namely, a bar type pole piece 51 is formed of a magnet and a coil 4 is wound around the bar type pole piece 51. Both side end portions of the bar type pole piece 51 have magnetic flux increasing openings 52, and also the bar type pole piece 51 has emission balance controlling openings 53 corresponding to each spaces between strings. 6.

In the following, the operation of the embodiment described above is explained. The magnetic flux increasing openings 52 of this embodiment operates similar to the magnetic flux increasing slits 45 of the second embodiment described above. Namely, the magnetic flux increasing openings 52 operates as a magnetic reluctance formed by the magnetic air-gap, deflects magnetic flux curving in the neighborhood in the direction of strings 6 and increases the relative quantity of magnetic flux. The emission balance controlling slits 53 operates similar to the magnetic flux increasing slits 46 of the second embodiment described above. Namely, the emission balance controlling slits 53 operates as a magnetic reluctance and concentrates the magnetic flux on each string 6 in position.

Figure 10:
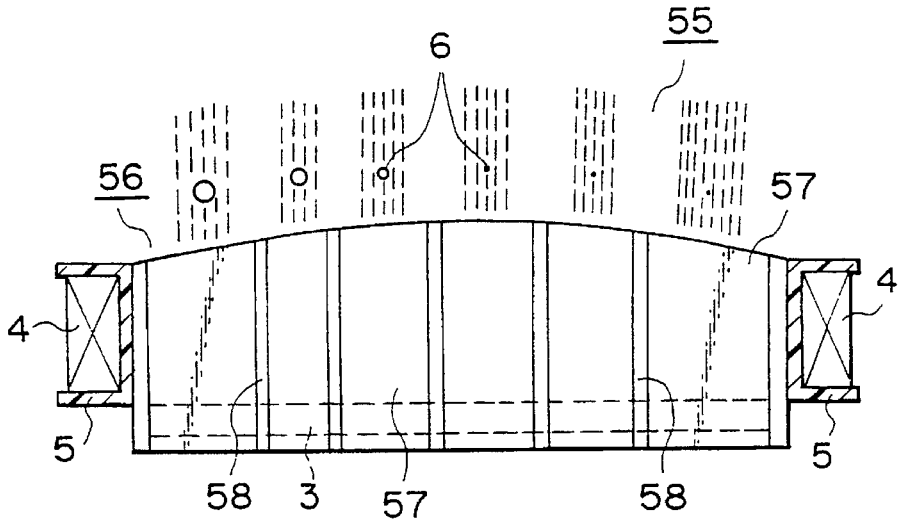
FIG. 10 is a schematic view of the fourth embodiment of the electromagnetic driver according to the present invention.

Next, the fourth embodiment of an electromagnetic driver having the magnetic flux emission deflecting means is explained briefly with reference to FIG. 10. In FIG. 10, the same portions as in the second embodiment have the same numerals as the second embodiment and the description in relation to those portions is omitted. In FIG. 5, reference numerals 55 is an electromagnetic driver and 56 is a bar type pole piece. The bar type pole piece 56 is magnetically combined with a magnet 3 and has two kind of magnetic materials. Namely, ferromagnetic portions 57 corresponding to a sixth string 6 are formed of a ferromagnetic material, e.g., iron, alnico and ferrite, and other feeble magnetic portions 58 located between each string 6 are formed of feeble magnetic material, e.g., copper or brass.

In the following, the operation of the embodiment described above is explained. Although the magnet 3 provides uniform magnetic flux to the bar type pole piece 56, the feeble magnetic portions 58 operates as a magnetic air-gap in relation to the ferromagnetic portions 57 because of different permeability between them, and consequentially produces a magnetic reluctance as described above and the quantity of magnetic flux emitted to each string 6 is controlled by a width of the ferromagnetic portions 57 or a deflection by the feeble magnetic portions 58.

Figure 11:
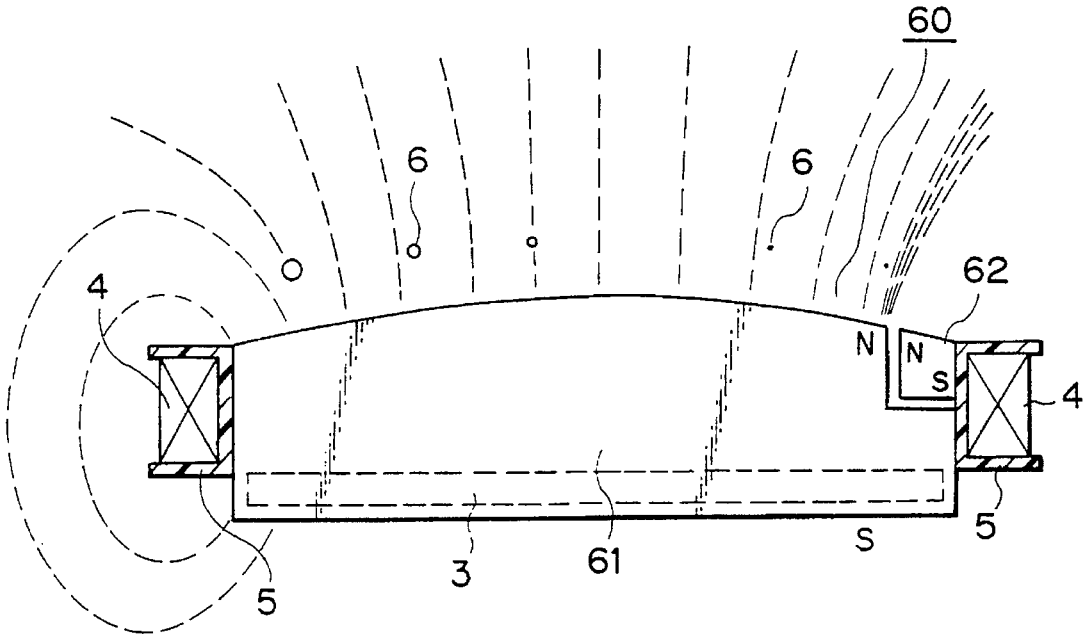
FIG. 11 is a schematic view of the fifth embodiment of the electromagnetic driver according to the present invention.

Next, the fifth embodiment of an electromagnetic driver having the magnetic flux emission deflecting means is explained briefly with reference to FIG. 11. In FIG. 11, the same portions as in the second embodiment have the same numerals as the second embodiment and the description in relation to those portions is omitted. In FIG. 11, reference numeral 60 is an electromagnetic driver, 61 is a bar type pole piece and 62 is a submagnet. The sub-magnet 62 is placed at a side end of the bar type pole piece 61 in the neighborhood of a first string 6, in which the polarity of a magnetic flux emission surface of the sub-magnet 62 is the same of a magnetic flux emission surface of the bar type pole piece 61.

In the following, the operation of the embodiment described above is explained. The bar type pole piece 61 emits magnetic flux as shown in FIG. 3. However, the sub-magnet 62 deflects magnetic flux emitted from the side end of the bar type pole piece 61 in the direction of the first string 6 by using the repulsion between two magnets that face each other with the same polarization, and thereby, increases the relative quantity of the magnetic flux emission in the direction of the first string 6.

Next, an embodiment of a new designed electromagnetic driver that significantly develops emission characteristics of driving magnetic energy and thereby, enables the reduction of an energy consumption is briefly explained. As described above, each constitution of the embodiments of an electromagnetic driver according to the present invention is similar to that of an electromagnetic driver in FIG. 2. However, the next embodiment is newly invented to specially operate as an electromagnetic driver.

Figure 12:
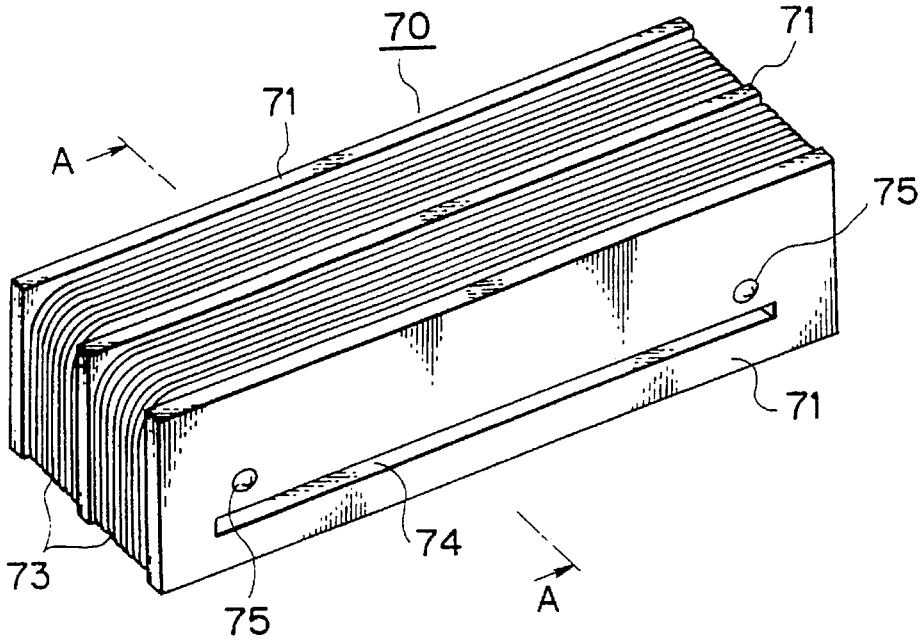
FIG. 12 is a schematic view of the sixth (1) embodiment of the electromagnetic driver according to the present invention.
Figure 13:
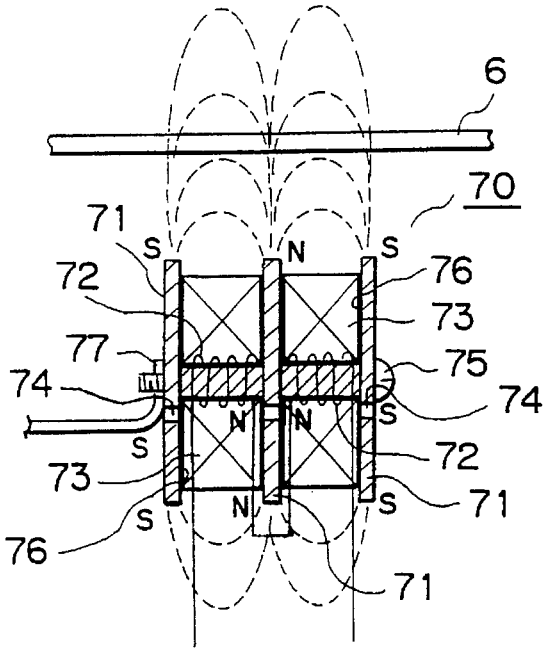
FIG. 13 is a schematic view of the sixth (2) embodiment of the electromagnetic driver according to the present invention.

In the following, the sixth embodiment of an electromagnetic driver of a device for sustaining the vibration of a string according to the present invention is explained briefly with reference to FIG. 12 and FIG. 13. In FIGS. 12 and 13, reference numeral 70 is an electromagnetic driver. The electromagnetic driver 70 has three bar type pole pieces 71 that are disposed at predetermined spaces parallel to each other at a right angle to the string 6. The bar type pole pieces 71 is formed of permeability material, e.g., iron or silicon steel plate. Reference numeral 72 is a permanent magnet that is a magnetic flux producing substance. The permanent magnets 72 are disposed parallel to the strings 6 between the center portion of the bar type pole pieces 71, magnetically combined with the bar type pole pieces 71 and having the same polarization in relation to the center bar type pole piece 71. Coils 73 are wound in opposite directions to each other around the permanent magnets 72.

Slits 74 are formed under and in the neighborhood of the permanent magnets 72 along nearly a total lateral length of the bar type pole pieces 71. Metal screws 75 associate with the bar type pole pieces 71 and the permanent magnets 72 wound with the coils 73. An insulating tape 76 adheres to composition planes of the bar type pole pieces 71 and the permanent magnets 72 that are in contact with the coils 73, and also an earth cable 77 is attached to one side end of the metal screws 75.

In the following, the operation of the embodiment described above is explained. Magnetic flux emitted from the bar type pole pieces 71 passes through the inside and is deflected in the upper direction by a magnetic reluctance produced by the slits 74 under the permanent magnets 72, and thereby, the magnetic flux is effectively provided to the strings 6. In FIG. 13, a magnetic line of force is schematically illustrated by a dotted line. Since the center of the bar type pole piece 71 has a reversed polarity in relation to the bar type pole pieces 71 on both sides, magnetic flux emitted from the bar type pole pieces 71 on both sides concentrates on the center of the bar type pole pieces 71 and the magnetic flux is not distributed outside the neighborhood of the strings 6. Therefore, the electromagnetic driver of this embodiment is very effective.

Figure 14:
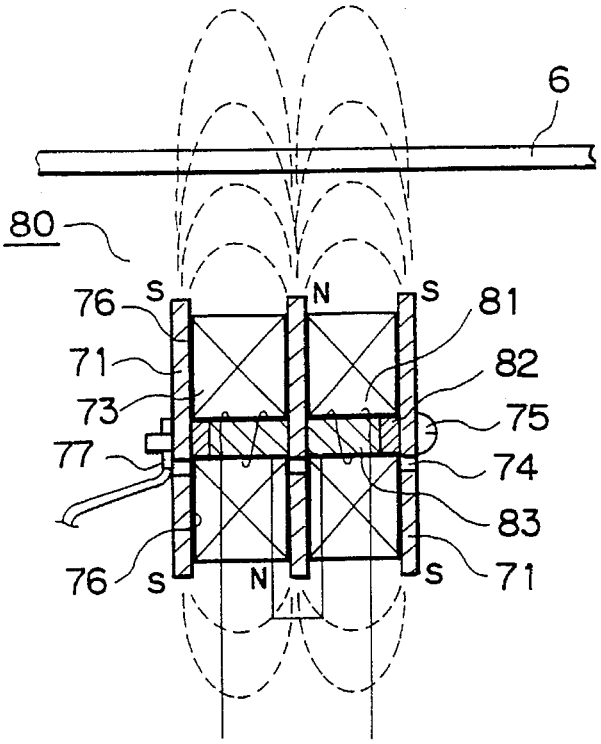
FIG. 14 is a schematic view of the seventh (1) embodiment of the electromagnetic driver according to the present invention.
Figure 15:
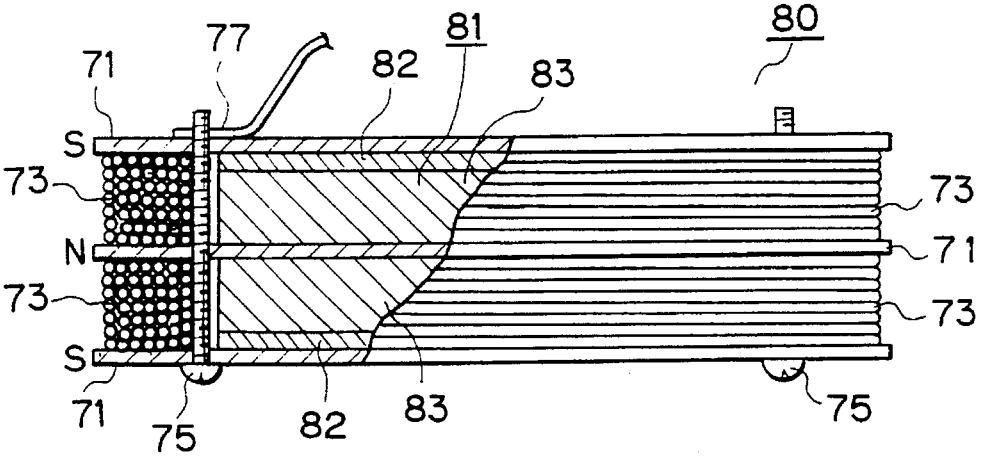
FIG. 15 is a schematic view of the seventh (2) embodiment of the electromagnetic driver according to the present invention.

Next, the seventh embodiment of an electromagnetic driver of a device for sustaining the vibration of a string is explained briefly with reference to FIG. 14 and FIG. 15. In FIGS. 14 and 15, the same portions as in the sixth embodiment have the same numerals as the sixth embodiment and the description in relation to those portions is omitted. In FIGS. 14 and 15, an electromagnetic driver 80 has a pair of magnetic flux producing substances 81. The magnetic flux producing substances 81 consist of a combination of a permanent magnet 82 and a ferromagnetic substance 83. The ferromagnetic substance 83 is formed of ferromagnetic material, e.g., ferrite that is still not polarized or iron, and magnetically combined with the permanent magnet 82. The permanent magnet 82 is placed at a position that is on the outside of the magnetic flux producing substances 81 and in contact with bar type pole pieces 71 on both sides.

In the following, the operation of the embodiment described above is explained. Considering the basic idea of this embodiment, it is suitable that the magnetic flux producing substances 81 ideally lie in cores of coils 73 and are formed of ferromagnetic material instead of permanent magnets, because the magnetic reluctance of the magnet drops in efficiency when generating a driving force. Therefore, the magnetic flux producing substances 81 of this embodiment are formed by a combination of the permanent magnet 82 and the ferromagnetic substance 83.

Figure 16:
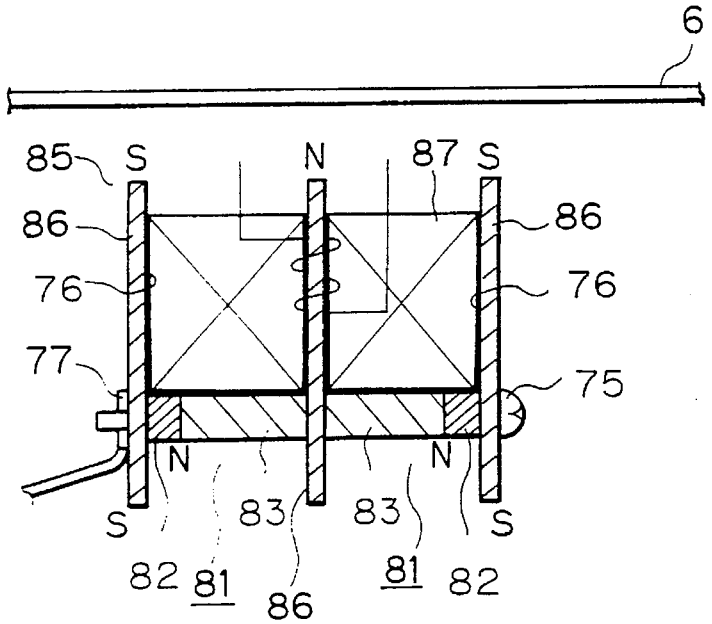
FIG. 16 is a schematic view of the eighth embodiment of the electromagnetic driver according to the present invention.

Next, the eighth embodiment of an electromagnetic driver of a device for sustaining the vibration of a string is explained briefly with reference to FIG. 16. In FIG. 16, the same portions as in the seventh embodiment have the same numerals as the seventh embodiment and the description in relation to those portions is omitted. In FIG. 16, an electromagnetic driver 85 has three bar type pole pieces 86, and the magnetic flux producing substances 81 are respectively located between the bar type pole pieces 86 at a right angle against the bar type pole pieces 86. A coil 87 is wound around the center bar type pole piece 86 such that the coil 87 faces the inside surfaces of the magnetic flux producing substances 81 and the other bar type pole pieces 86 between the magnetic flux producing substances 81 and the strings 6. A brief description of the operation of the embodiment described above is omitted because the description is similar to that of the seventh embodiment. The slit that is formed along nearly a total lateral length of each of the three bar type pole pieces as described above may be rejected. Further, the polarity arrangement of the magnetic flux producing substances is not limited to that of the embodiment, namely, the polarity of the center bar type pole piece is different from that on both sides.

Although an example wherein permanent magnets face both sides out of three bar type pole pieces is explained in the eighth embodiment, it is preferable that each permanent magnet be sandwiched between two ferromagnetic substances. The magnetic flux producing substance is a permanent magnet in the seventh embodiment and is a combination of a permanent magnet and ferromagnetic substance in the eighth embodiment. However, the magnetic flux producing substance is not limited by those embodiments, and may be a ferromagnetic material weakly polarized, e.g., ferrite or iron.

Figure 17:
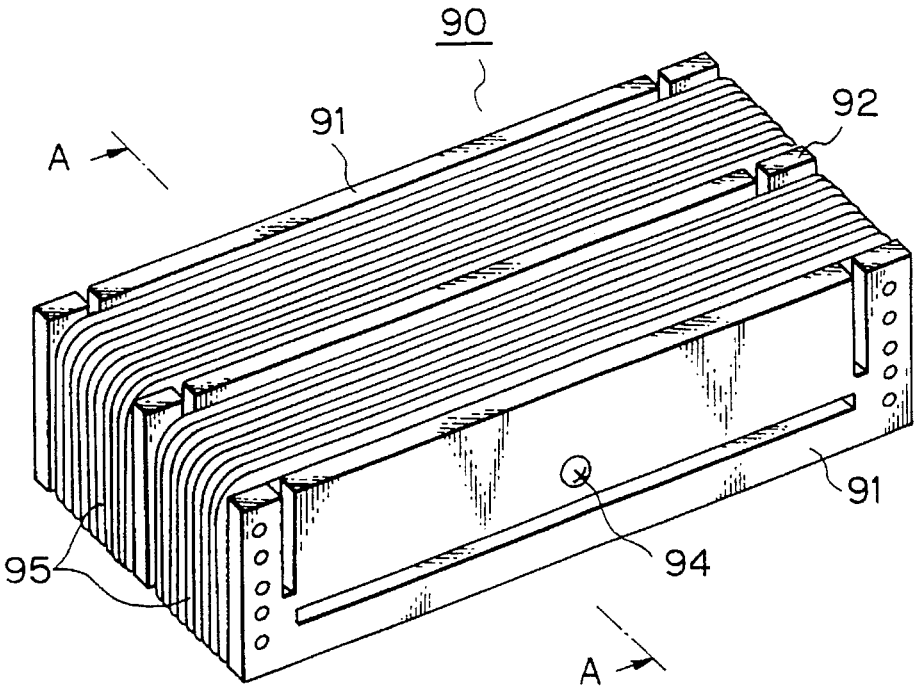
FIG. 17 is a schematic view of the ninth (1) embodiment of the electromagnetic driver according to the present invention.
Figure 18A:
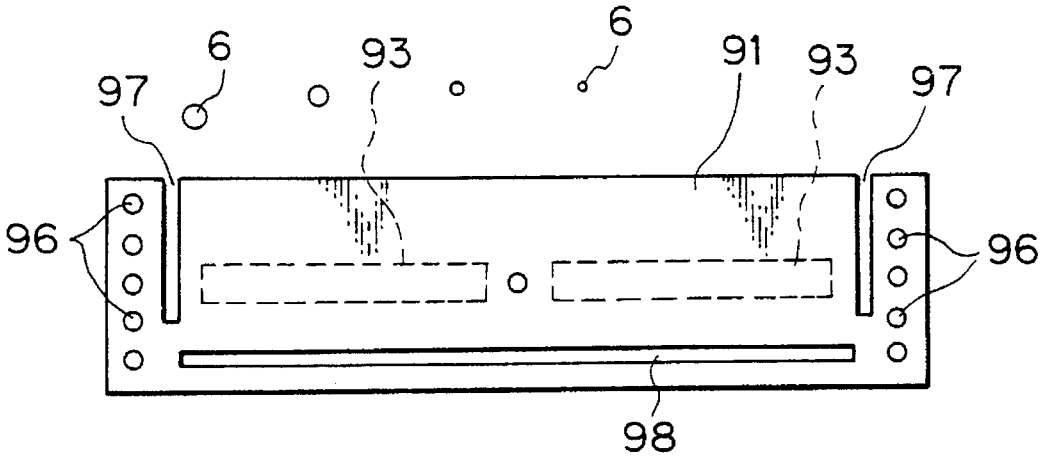
FIG. 18(*a*) and FIG. 18(*b*) are schematic views of the ninth (2) embodiment of the electromagnetic driver according to the present invention.
Figure 18B:
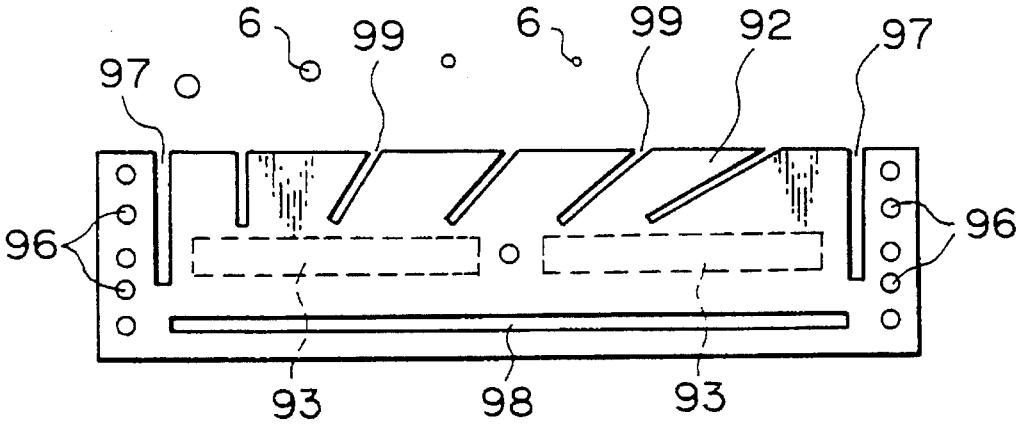

Next, the ninth embodiment of an electromagnetic driver of a device for sustaining the vibration of a string is explained briefly with reference to FIG. 17 and FIG. 18. In FIGS. 17 and 18, an electromagnetic driver 90 has three bar type pole pieces 91, 92. Bar type pole pieces 91 on both sides have shapes as shown in FIG. 18(*a*) and a center bar type pole piece 92 has a shape as shown in FIG. 18(*b*). Magnets 93 are sandwiched between three bar type pole pieces 91, 92 and are fixed by a screw 94 in a body. Coils 95 are wound around the magnets 93. Each bar type pole piece 91, 92 has a magnetic flux emission deflecting means that properly controls the magnetic flux emission balance and a relative quantity of magnetic flux emission corresponding to each string 6. Namely, each bar type pole piece 91 on both sides in FIG. 18(*a*) has magnetic flux increasing openings 96 and magnetic flux increasing slits 97 on both sides, and further has a downward magnetic flux controlling slit 98 that reduces magnetic flux emitted in the reverse direction of the strings 6. The center bar type pole piece 92 in FIG. 18(*b*) has emission balance controlling slits 99 that keeps an optimum magnetic flux emission balance corresponding to each string 6 as described above in FIG. 8 except for those magnetic air-gaps described above. A brief description of the operation of the embodiment described above is omitted because the description is similar to that of several embodiments described above.

Figure 19:
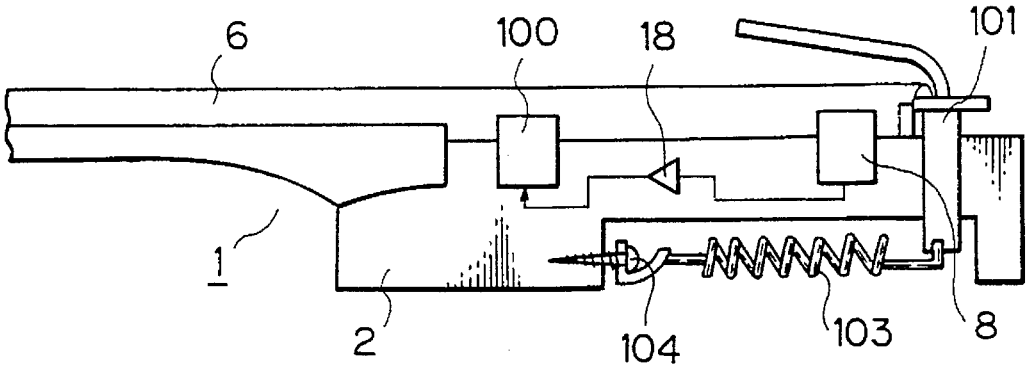
FIG. 19 is a schematic view of the tenth (1) embodiment of the electromagnetic driver according to the present invention.
Figure 20:
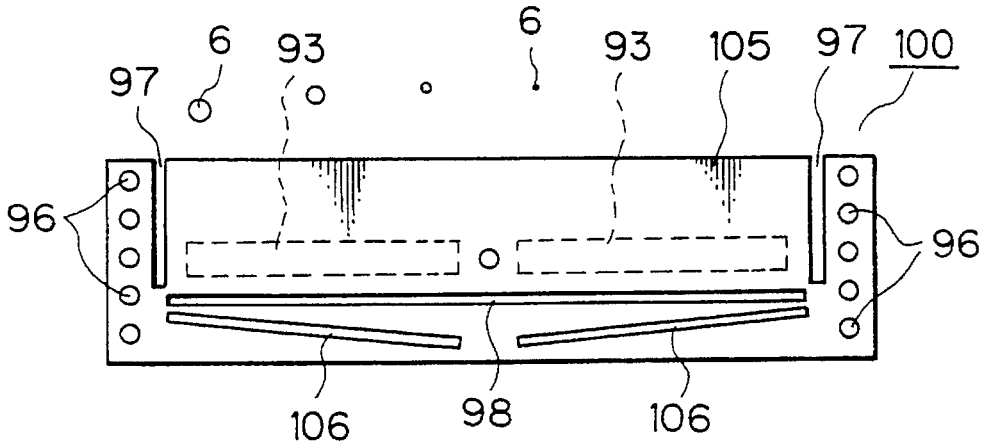
FIG. 20 is a schematic view of the tenth (2) embodiment of the electromagnetic driver according to the present invention.

Next, the tenth embodiment of an electromagnetic driver of a device for sustaining the vibration of a string is explained briefly with reference to FIG. 19 and FIG. 20. In FIGS. 19 and 20, the same portions as in the ninth embodiment have the same numerals as the ninth embodiment and the description in relation to those portions is omitted. In FIGS. 19 and 20, an electromagnetic driver 100 is mounted on a body 2 of an electric guitar 1. An electromagnetic pickup 8 provides output to an amplifier 18, and output from the amplifier 18 is applied to the electromagnetic driver 100. A Tremolo device 101 is mounted on the body 2 to provide pitch change capability by varying string tension by rocking a bar. A spring 103 is used to return the Tremolo device 101 to a predetermined position, and one end of the spring 103 is combined with the Tremolo device 101 and another is attached to the body 2 by a metal screw. The electromagnetic driver 100 basically has the same constitution as the fourth embodiment described above and further has downward deflecting slits 106 added in a bar type pole piece 105.

In the following, the operation of the embodiment described above is explained. The electromagnetic driver 100 emits magnetic energy for driving a string 6. The driving magnetic energy is detected by the electromagnetic pickup 8 and a detected electric signal is amplified by the amplifier 18. An amplified signal is converted to magnetic energy by the electromagnetic driver 100. The driving magnetic energy is emitted in the direction of the string 6 and in the reverse direction of the string 6. The emitted magnetic energy is properly controlled by various magnetic air-gaps 96, 97, 98 as described above. However, inside the body 2 of the guitar 1, particularly under and in the neighborhood of the electromagnetic driver 100 there is the metal spring 103, the metal screw 104 and the Tremolo device 101 made of iron as described above, and thereby, a so-called magnetic feedback is produced by magnetic energy emitted from the bottom of the electromagnetic driver 100 through said metal devices that forms a magnetic circuit. The downward deflecting slits 106 prevent the production of the magnetic feedback through said metal parts by distributing the magnetic energy emitted from the bottom of the electromagnetic driver 100 in the right and left direction.

Figure 21:
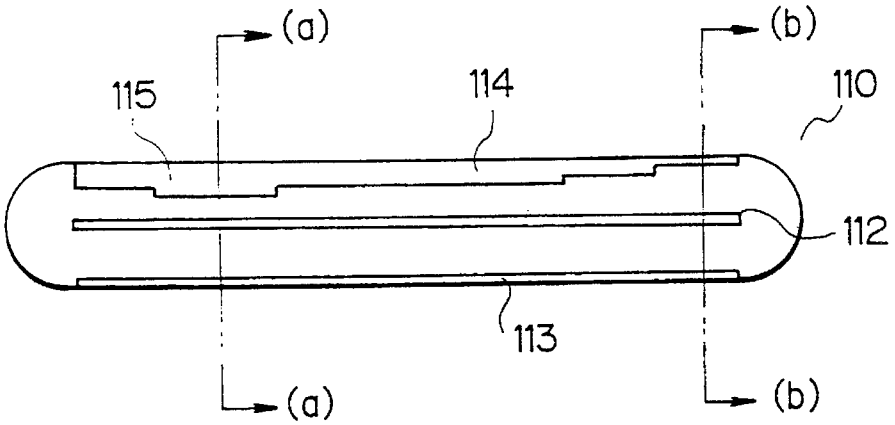
FIG. 21 is a schematic view of the eleventh (1) embodiment of the electromagnetic driver according to the present invention.
Figure 22A:
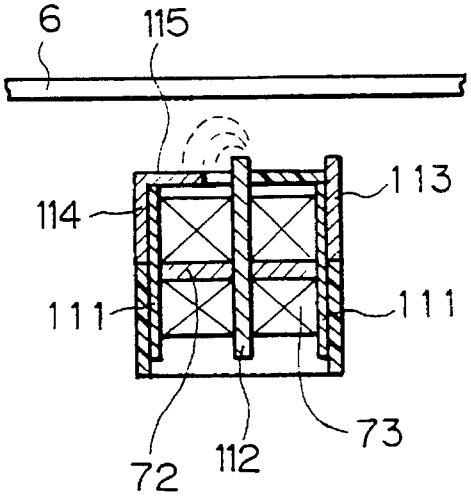
FIG. 22(*a*) and FIG. 22(*b*) are schematic views of the eleventh (2) embodiment of the electromagnetic driver according to the present invention.
Figure 22B:
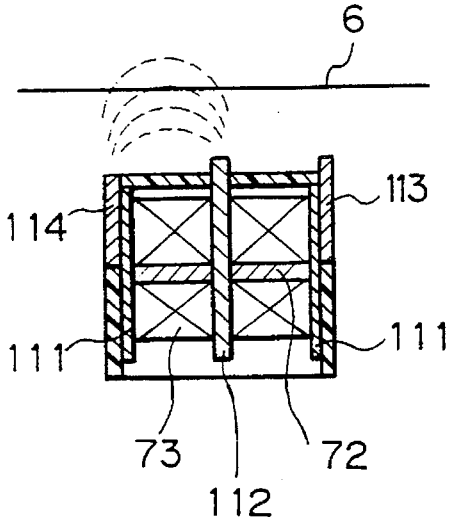

Next, the eleventh embodiment of an electromagnetic driver of a device for sustaining the vibration of a string is explained briefly with reference to FIG. 21 and FIG. 22. In FIGS. 21 and 22, the same portions as in the eighth embodiment have the same numerals as the eighth embodiment and the description in relation to those portions is omitted. One embodiments shows an excitation balance matching means that provides gap-spaces between bar type pole pieces corresponding to each string to their respective strings, and another shows a magnetic flux emission controlling means that utilizes a magnetic saturation phenomenon. In FIGS. 21 and 22, an electromagnetic driver 110 has three bar type pole pieces 111, 112 as described above. Both side bar type pole pieces 111 are much thinner than a center bar type pole piece 112, for example the thickness of the bar type pole piece 111 is about 0.5 mm. Also, a permeability plate 113 is attached to the upper half of the bar type pole piece 111 (right side of a cross section view in FIG. 22) on the side of a body end of a guitar. The permeability plate 113 is made of soft iron, the thickness of the permeability plate 113 is relatively thick, e.g., about 1.2 mm, and magnetically combined with the bar type pole piece 111. A L permeability plate 114 is attached to another upper half of the bar type pole piece 111 and magnetically combined with the bar type pole piece 111. A top face 115 of the L permeability plate 114 is processed such that there are predetermined gap-spaces between the top face 115 and the center bar type pole piece 112 corresponding to each string 6. The predetermined gap-spaces are provided such that a gap-space corresponding to a first string 6 is relatively wide and a gap-space corresponding to a fifth string 6 is relatively narrow.

In the following, the operation of the embodiment described above is explained. In this embodiment a loop of magnetic flux is formed between the center bar type pole piece 112 and the bar type pole pieces 111 on both sides as well as the embodiment as described above. Magnetic flux emission reaches the strings 6 in the case that a gap-space between the tip of the top face 115 of the L permeability plate 114 and the center bar type pole piece 112 is wide as shown in FIG. 22(*b*). Conversely, magnetic flux emission can hardly reach the strings 6 in the case that a gap-space between the tip of the top face 115 of the L permeability plate 114 and the center bar type pole piece 112 is narrow as shown in FIG. 22(*a*). In the latter case, little driving force is provided to a string 6, and thereby the quantity of excitation of a string becomes small. Applying as described above, the optimum excitation balance between strings 6 can be realized. Also, the bar type pole piece 111 on both sides is formed by a thin permeability element and a magnetic saturation phenomenon easily occurs so that magnetic flux emission over a predetermined magnetic flux emission level is disabled. However, magnetic flux emission in the upper direction can be realized by the permeability plate 113 and the L permeability plate 114 attached to the upper half of the bar type pole pieces 111, which are still not saturated with said magnetic flux emission level and moreover strengthens magnetic flux emission in the direction of the strings 6.

In those embodiments described above, a magnetic flux emission deflecting means is for example slits, openings, a combination of ferromagnetic substances and weak magnetic substances and a sub-magnet. However, the constitution of the present invention is no limited by those of the embodiments, every constitution or means for deflecting magnetic flux emission may be included within the concept of the present invention.

In the second and third embodiments, both a magnetic air-gap for increasing the relative quantity of magnetic flux and a magnetic air-gap for controlling the magnetic flux emission balance corresponding to each string are explained. If need be, either magnetic air-gap may be individually used. Further, the width, shape and design of a slit or the size and disposition of an opening are not limited by those of this embodiment and may be properly changed in relation to application thereof or an output balance between strings.

Further, although a combination of weak magnetic substances and ferromagnetic substances is explained in the fourth embodiment, the weak magnetic substances may be non-magnetic substance, e.g., ceramic, plastic and aluminum so as to positively deflect magnetic flux.

In the fifth embodiments, a sub-magnet is only placed at an end portion on the side of a first string, however, the sub-magnet may be placed at a reverse end portion on the side of a sixth string.

Furthermore, the present invention may be applied to whichever type of an electromagnetic driver using a single type pole piece or a bar type pole piece, and the bar type pole piece may be formed of only a magnet or a ferromagnetic material magnetically combined with a magnet.

As described above, an electromagnetic driver of a device for sustaining the vibration of a string according to the present invention has a phase control circuit provided in an amplifying means and/or an excitation balance matching means in order to provide well-balanced excitation to each of the strings with the mass and tension of each string being different, and thereby, each string having a different characteristic can be excited by a substantially uniform and well-balanced driving force. Particularly, the least excitable string, for example a first string, is provided with optimum conditions regarding phase characteristics to sustain the vibration of the string and the other strings are provided with progressively mismatched conditions so as to suitably weaken the vibration of the strings, and thereby, each string can be uniformly excited while maintaining a balance between the strings and further said substantially uniform and well-balanced driving force enables the playing of a sustained chord by simultaneous excitation of plural strings, although it was difficult to play a chord using a device for sustaining the vibration of the strings in the prior art.

Therefore, according to the present invention, a string muting operation, which is one of the playing methods of a guitar, by a substantially uniform and well-balanced driving force, is not required, although optimum excitation for a first string, which provides a fifth string with excessive excitation, causes a fifth string to occasionally produce a self-oscillation in the prior art. Thus, there are merits in that the playing operation of a guitar becomes easier and energy consumption is reduced because excessive excitation of each string as in the prior art other than the first string is not necessary.

Furthermore, an electromagnetic driver of a device for sustaining the vibration of a string according to the present invention has a magnetic flux emission controlling means for controlling the relative quantity of magnetic flux emission in the direction of a string, and thereby, magnetic flux emitted from the electromagnetic driver in various directions is concentrated in the direction of a string so that the relative quantity of magnetic flux in the direction of a string increases, and thereby, energy consumption necessary for driving a string is minimized and further the life-time of a dry cell battery, as the power supply of the device for sustaining the vibration of a string, is prolonged.

Particularly, according to an electromagnetic driver of a device for sustaining the vibration of a string as shown in embodiments from the second to the eleventh embodiment, the electromagnetic driver having a bar type pole piece can deflect magnetic flux in the direction of a string and/or can deflect magnetic flux so as to reduce the difference in excitation and volume between the strings by providing an optimum magnetic flux corresponding to each string, and thereby, it is possible to increase the relative quantity of magnetic flux emission and/or optimum magnetic flux emitting balance corresponding to each string.

Also, there is an advantage in that a substantially uniform and well-balanced vibration can be maintained by a constitution increasing the relative quantity of magnetic flux and magnetic flux corresponding to a first string.

Further, there are some merits in that only the least excitable string can be reinforced as described above, and thereby, it is possible to prevent useless self-oscillation of the other string other than the least excitable string produced by a relatively excessive driving force provided to drive the least excitable string in the prior art and to play a sustained chord by said substantially uniform and well-balanced driving force, and further the playing operation of a guitar becomes easier because a mute operation is not necessary as described above, and furthermore energy consumption is reduced as described above and the life-time of a dry cell battery as a power supply of the device for sustaining the vibration of a string is prolonged.

Further, according to embodiments from the sixth to the eleventh embodiment, the electromagnetic driver has three bar type pole pieces and two magnetic flux producing substances sandwiched between them, and only the polarity of a center bar type pole piece is different from that of other bar type pole pieces on both sides, and thereby, there are several advantages in that magnetic flux is concentrated on the center portion in the neighborhood of the strings, and thereby, said magnetic flux enables a string to be efficiently excited by little electric power and so the power consumption of the dry cell battery mounted on a guitar is reduced significantly.

Further, according to the second embodiment and the ninth embodiment, magnetic air-gaps are formed by slits. An area of a bar type pole piece corresponding to a first string is made large, and thereby, there is a merit in that magnetic flux is efficiently emitted from a surface of the large area in association with electromagnetic conversion efficiency and the area. Furthermore, a surface facing a coil is reduced by the slits and an induced inductance decreases, and thereby, there is a merit in that the resonance point of the electromagnetic driver rises and high frequency performance is developed.

Further, according to embodiments from the sixth to the eleventh embodiment, a magnet is placed at a center portion of an electromagnetic driver parallel with the strings and magnetic air-gaps are added under the magnet, thereby, there is a merit in that magnetic flux emitted in the direction of a string increases by preventing magnetic flux emitted downward and deflecting the magnetic flux in the direction of a string.

Further, according to an electromagnetic driver of a device for sustaining the vibration of a string as shown in the eighth embodiment, a Tremolo device, a spring and a metal screw form a magnetic circuit and so-called magnetic feedback is produced by magnetic flux emitted from the bottom of the electromagnetic driver through said metal devices. Downward deflecting slits prevent the production of the magnetic feedback by properly distributing downward magnetic flux.

Further, according to the seventh embodiment, a magnetic flux producing substance is formed by a combination of a permanent magnet and a ferromagnetic substance, and thereby, efficiency of the magnetic flux producing substance is significantly developed compared with a magnetic flux producing substance made of only a permanent magnet because the magnetic reluctance of the former is smaller than that of the latter while in operation.

Furthermore, there is a merit in that an electromagnetic driver of this embodiment is basically formed only by processing a bar type pole piece and a magnetic flux producing substance. Therefore, there is no need of plastic mold elements such as a bobbin in the electromagnetic driver and so various widths, lengths and shapes of the electromagnetic driver can be easily realized. Also, the production of the electromagnetic driver is completed by substantially fixing the magnetic flux producing substance on the bar type pole piece with a screw instead of assembling several parts, e.g., a permanent, a base plate and a cover, into a electromagnetic driver after a coil is wound around a bobbin. Therefore, the electromagnetic driver of this embodiment is very convenient for inexpensive mass production thereof.

I claim:

1. A stringed musical instrument comprising a plurality of strings, each of which has a mass and tension different from the others, and a device for sustaining the vibration of the strings, said device comprising:

pickup means for detecting the vibration of the strings and producing an electric signal in response to said vibration;

amplifying means for amplifying the electric signal from said pickup means and producing a driving signal output;

electromagnetic driver means for receiving said driving signal output and emitting magnetic flux to excite each of said strings; and excitation balance matching means comprising a phase control circuit in said amplifying means for providing a total balanced excitation between said plurality of strings by adjusting the relative quantities of magnetic flux provided to said strings in correspondence to the mass and tension of each of said strings.

2. A stringed instrument as set forth in claim 1 wherein said phase control circuit has a fixed phase characteristic and causes each string to be excited by a uniform and balanced driving force such that a least excitable string is provided with an optimum condition of the phase characteristic to sustain the vibration of the string and other strings are provided with a progressively mismatched condition to weaken the vibration of the strings suitably.

3. A stringed instrument as set forth in claim wherein a plurality of said phase control circuits are provided, each corresponding to one of said strings, each phase control circuit having a respective fixed phase characteristic and causing a corresponding string to be excited by a uniform and balanced driving force such that the least excitable string is provided with an optimum condition of the phase characteristic of its corresponding phase control circuit to sustain the vibration of the string and the other strings are each provided with another predetermined condition of the phase characteristic of the corresponding phase control circuit to weaken the vibration of the string.

4. A stringed instrument as set forth in claim 2 or 3 wherein said phase control circuit enables the excitation of a plurality of the strings simultaneously by the application to each string of a uniform and balanced driving force.

5. A stringed instrument as set forth in claim 2 or 3 wherein said least excitable string is the highest frequency string.

6. A stringed instrument as set forth in claim 1, wherein said phase control circuit provides a balanced excitation to each of said plurality of strings, enabling the playing of a chord by said phase control circuit.

7. The stringed instrument as set forth in claim 6, wherein said electromagnetic driver means comprises a coil and a plurality of pole pieces each corresponding to one of said strings and shaped so as to emit a magnetic flux for its corresponding string which provides a balanced excitation to each of said plurality of strings.

8. An electromagnetic driver used in a device for sustaining the vibration of the strings of a musical instrument having a plurality of strings, each of which has a mass and tension different from the others, which driver comprises means for emitting magnetic flux to excite said plurality of strings, and means for uniformly providing a total balanced excitation between each of said plurality of strings by controlling the quantity of magnetic flux emission provided to each of the strings in correspondence to the mass and tension of each of said strings, wherein said electromagnetic driver has a coil and a plurality of pole pieces each corresponding to one of said strings and shaped so as to emit a magnetic flux for its corresponding string which provides said balanced excitation between each of said plurality of strings.

9. The electromagnetic driver of claim 8, wherein the electromagnetic driver comprises a permanent magnet, a coil and a bar type pole piece magnetically combined with the permanent magnet, and said means for providing a balanced excitation and controlling the quantity of magnetic flux emission is a magnetic flux emission deflecting means formed in the bar type pole piece for deflecting emitted magnetic flux.

10. The electromagnetic driver of claim 9, wherein said bar type pole piece has a straight upper end.

11. The electromagnetic driver of claim 9, wherein said bar type pole piece is a plate formed of a permanent magnet.

12. The electromagnetic driver of claim 9, wherein said bar type pole piece is a plate formed of a magnetic substance magnetically combined with a permanent magnet.

13. The electromagnetic driver of claim 9, wherein said magnetic flux emission deflecting means is a sub-magnet placed at a position in which a polarity of a magnetic flux emission surface of the sub-magnet is the same as a magnetic flux emission surface of said bar type pole piece.

14. The electromagnetic driver of claim 13, wherein said sub-magnet is disposed at least in the neighborhood of the highest frequency string.

15. The electromagnetic driver of claim 9, wherein said magnetic flux emission deflecting means is a magnetic air gap formed in the bar type pole piece.

16. The electromagnetic driver of claim 15, wherein said magnetic air-gap is a slit.

17. The electromagnetic driver of claim 15, wherein said magnetic air-gap is a small hole.

18. The electromagnetic driver of claim 15, wherein said magnetic air-gap is a gap.

19. The electromagnetic driver of claim 15, wherein said magnetic air-gap is at least one of a non-magnetic substance and a weak magnetic substance.

20. An electromagnetic driver for a device for sustaining the vibration of a string, comprising:

three spaced-apart bar type pole pieces disposed in parallel to each other at a right angle to the string;

a pair of magnetic flux producing substances, each positioned on a side of the center pole piece different from the other and between two of said pole pieces in parallel with the string, magnetically combined with the bar type pole pieces and having the same polarization in relation to the center bar type pole piece, and a coil wound around each magnetic flux producing substance or the center bar type pole piece.

21. The electromagnetic driver as set forth in claim 20, wherein said magnetic flux producing substance is a permanent magnet.

22. The electromagnetic driver as set forth in claim 20, wherein said magnetic flux producing substance comprises a combination of a permanent magnet and a ferromagnetic substance.

23. The electromagnetic driver as set forth in claim 20, wherein said magnetic flux producing substance is a weakly polarized ferromagnetic material.

24. The electromagnetic driver as set forth in claim 20, wherein a permanent magnet is positioned apart from the center portion of each of said magnetic flux producing substances in contact with an outer one of said pole pieces.

25. The electromagnetic driver as set forth in claim 20, wherein said bar type pole piece has a slit formed under and in the neighborhood of said magnetic flux producing substance along the length of the bar type piece.

26. An electromagnetic driver used in a device for sustaining the vibration of the strings of a musical instrument having a plurality of strings, each of which has a mass and tension different from the others, which driver comprises means for emitting magnetic flux to excite said plurality of strings, and means for uniformly providing totally balanced excitation between said plurality of strings by providing different quantities of magnetic flux to each of said strings in accordance with the mass and tension thereof, wherein said means for providing a balanced excitation comprises a coil and a plurality of pole pieces each corresponding to one of said strings and shaped so as to emit a magnetic flux for its corresponding string which provides said balanced excitation between each of said plurality of strings.

27. The electromagnetic driver of claim 26, wherein said means for providing a balanced excitation comprises a permanent magnet, a coil and a bar type pole piece magnetically combined with the permanent magnet, and magnetic flux emission deflecting means formed in the bar type pole piece for deflecting emitted magnetic flux.

28. The electromagnetic driver of claim 27, wherein said bar type pole piece has a straight upper end.

29. The electromagnetic driver of claim 27, wherein said bar type pole piece is a plate formed of a permanent magnet.

30. The electromagnetic driver of claim 27, wherein said bar type pole piece is a plate formed of a magnetic substance magnetically combined with a permanent magnet.

31. The electromagnetic driver of claim 27, wherein said magnetic flux emission deflecting means is a sub-magnet placed at a position in which a polarity of a magnetic flux emission surface of the sub-magnet is the same as a magnetic flux emission surface of said bar type pole piece.

32. The electromagnetic driver of claim 31, wherein said sub-magnet is disposed at least in the neighborhood of the highest frequency string.

33. The electromagnetic driver of 27, wherein said magnetic flux emission deflecting means is a magnetic air gap formed in the bar type pole piece.

34. The electromagnetic driver of claim 33, wherein said magnetic air-gap is a slit.

35. The electromagnetic driver of claim 33, wherein said magnetic air-gap is a small hole.

36. The electromagnetic driver of claim 33, wherein said magnetic air-gap is a gap.

37. The electromagnetic driver of claim 33, wherein said magnetic air-gap is at least one of a non-magnetic substance and a weak magnetic substance.

38. An electromagnetic driver used in a device for sustaining the vibration of the strings of a musical instrument having a plurality of strings, each of which has a mass and tension different from the others, which driver comprises means for emitting magnetic flux to excite said plurality of strings, and means for controlling the quantity of magnetic flux emission in the direction of each of the strings so that the quantity of magnetic flux provided to each string is in correspondence to the mass and tension thereof, wherein said electromagnetic driver has a coil and a plurality of pole pieces each corresponding to one of said strings and shaped so as to emit a controlled quantity of magnetic flux for its corresponding string.

39. The electromagnetic driver of claim 38, wherein the electromagnetic driver comprises a permanent magnet, a coil and a bar type pole piece magnetically combined with the permanent magnet, and said means for controlling the quantity of magnetic flux emission is a magnetic flux emission deflecting means formed in the bar type pole piece for deflecting emitted magnetic flux.

40. The electromagnetic driver of claim 39, wherein said bar type pole piece has a straight upper end.

41. The electromagnetic driver of claim 39, wherein said bar type pole piece is a plate formed of a permanent magnet.

42. The device for sustaining the vibration of one or more strings as set forth in claim 39 wherein said bar type pole piece is a plate formed of a magnetic substance magnetically combined with a permanent magnet.

43. The electromagnetic driver of claim 39, wherein said magnetic flux emission deflecting means is a sub-magnet placed at a position in which a polarity of a magnetic flux emission surface of the sub-magnet is the same as the magnetic flux emission surface of said bar type pole piece.

44. The electromagnetic driver of claim 43, wherein said sub-magnet is disposed at least in the neighborhood of the highest frequency string.

45. The electromagnetic driver of claim 39, wherein said magnetic flux emission deflecting means is a magnetic gap formed in the bar type pole piece.

46. The electromagnetic driver of claim 45, wherein said magnetic air-gap is a slit.

47. The electromagnetic driver of claim 45, wherein said magnetic air-gap is a small hole.

48. The electromagnetic driver of claim 45, wherein said magnetic air-gap is a gap.

49. The electromagnetic driver of claim 45, wherein said magnetic air-gap is at least one of a non-magnetic substance and a weak magnetic substance.

* * * * *